US011174528B2

(12) United States Patent
Zhang et al.

(10) Patent No.: US 11,174,528 B2
(45) Date of Patent: Nov. 16, 2021

(54) OIL-IMMERSION QUENCHING COOLING PRECURSOR AND OIL-IMMERSION QUENCHING COOLING METHOD

(71) Applicant: BEIJING HUALI FINE CHEMICAL CO., LTD., Beijing (CN)

(72) Inventors: Kejian Zhang, Beijing (CN); Shui Wang, Beijing (CN); Xuezhi Hao, Beijing (CN); Shengdong Ge, Beijing (CN)

(73) Assignee: BEIJING HUALI FINE CHEMICAL CO., LTD., Beijing (CN)

( * ) Notice: Subject to any disclaimer, the term of this patent is extended or adjusted under 35 U.S.C. 154(b) by 130 days.

(21) Appl. No.: 15/750,734

(22) PCT Filed: Jun. 20, 2016

(86) PCT No.: PCT/CN2016/086405

§ 371 (c)(1),
(2) Date: Feb. 6, 2018

(87) PCT Pub. No.: WO2017/028621

PCT Pub. Date: Feb. 23, 2017

(65) Prior Publication Data

US 2019/0003001 A1 Jan. 3, 2019

(30) Foreign Application Priority Data

Aug. 20, 2015 (CN) ..... 201510516350.8

(51) Int. Cl.
*C21D 9/28* (2006.01)
*C21D 1/64* (2006.01)
(Continued)

(52) U.S. Cl.
CPC ..... *C21D 9/28* (2013.01); *C21D 1/58* (2013.01); *C21D 1/63* (2013.01); *C21D 1/64* (2013.01); *C21D 1/18* (2013.01); *C21D 1/62* (2013.01)

(58) Field of Classification Search
None
See application file for complete search history.

(56) References Cited

U.S. PATENT DOCUMENTS 2,513,165 A * 6/1950 Gilreath ..... A01B 29/041 172/545
3,844,925 A * 10/1974 Stathakos ..... G01N 27/44795 204/610

(Continued)

FOREIGN PATENT DOCUMENTS

CN 201125256 Y 10/2008
CN 203683588 U 7/2014

(Continued)

*Primary Examiner* — Brian D Walck

(57) ABSTRACT

An oil-immersion quenching cooling precursor and an oil-immersion quenching cooling method includes an axle-type workpiece or a workpiece that has sections in an axle form. Several separation rings are arranged on the workpiece in the axial direction to separate the axle-type workpiece or the workpiece that has sections in an axle form into a plurality of sections before oil-immersion quenching cooling. In the method, there is a cutting procedure before a quenching cooling procedure. Several separation rings distributed in the axial direction are reserved outside a dimension required for the workpiece. sections before oil-immersion quenching cooling. In the method, there is a cutting procedure before a quenching cooling procedure. Several separation rings distributed in the axial direction are reserved outside a dimension required for the workpiece.

7 Claims, 6 Drawing Sheets

(51) Int. Cl.

| | |
|---|---|
| ***C21D 1/63*** | (2006.01) |
| ***C21D 1/58*** | (2006.01) |
| ***C21D 1/18*** | (2006.01) |
| ***C21D 1/62*** | (2006.01) |

(56) References Cited

U.S. PATENT DOCUMENTS

| | | | | |
|---|---|---|---|---|
| 4,836,372 | A * | 6/1989 | Shelton | F16B 15/08 206/344 |
| 6,308,547 | B1 * | 10/2001 | Heess | B21D 3/00 72/107 |
| 2007/0062628 | A1 * | 3/2007 | Aeschlimann | B29C 66/8322 156/1 |
| 2007/0177960 | A1 * | 8/2007 | Tadros | F16B 15/06 411/451.1 |

FOREIGN PATENT DOCUMENTS

| | | | |
|---|---|---|---|
| CN | 104232874 | A | 12/2014 |
| CN | 105002331 | A | 10/2015 |
| CN | 205223291 | U | 5/2016 |
| JP | S591634 | A | 1/1984 |

* cited by examiner

Sample 1a without a separation ring

Sample 1b with separation rings

Sample 2a without a separation ring

Sample 2b with separation rings

OIL-IMMERSION QUENCHING COOLING PRECURSOR AND OIL-IMMERSION QUENCHING COOLING METHOD

FIELD OF THE INVENTION

The present invention relates to the technical field of oil-immersion cooling of workpieces in heat treatment of metals, in particular to an oil-immersion quenching cooling precursor that is separated into a plurality of sections to expel gas bubbles and an oil-immersion quenching cooling method.

BACKGROUND OF THE INVENTION

In the production process, most axle-type workpieces are heated and quenched in a vertically hung state in order to reduce flexural deformation of the workpieces in the heating and quenching cooling process. The quenching mentioned here includes a quenching process for a purpose of obtaining a martensitic structure in certain depth as well as a cooling process for obtaining a fine pearlite structure in large-diameter workpieces by oil-immersion cooling. Until now, the consensus in the industry is that there are two major factors that have influence on the quenching cooling rate of workpieces: one factor is the cooling characteristics of the cooling medium, and the other factor is the effective thickness of the quenched workpiece. To study the influence of the cooling characteristics of a cooling medium on the cooling rate, a cooling characteristic curve of the cooling medium must be first detected and plotted. The curve reflects the cooling characteristics of the cooling medium in vapor film stage, boiling cooling stage, and convection cooling stage, and reveals a one-to-one relationship between the surface temperature and the surface heat flux density of the workpiece in each of the stages. In addition, it is common knowledge in the art that the workpiece cools very slowly in the vapor film stage because the thermal conductivity of a vapor film is very poor. In other words, the gas in a vapor film doesn't flow. In fact, there is no report on the flow of gas in a vapor film up to now.

Regarding the influence of the effective thickness of workpiece on the cooling rate, it is widely believed in the industry that the parts of the same workpiece that have the same effective thickness usually obtain the same quenching cooling effect. Then, in the quenching process of workpieces in the same furnace, the cooling effect of the parts of the same axle-type workpiece should be essentially the same without any obvious difference, because the parts have the same effective thickness. This is the widely accepted belief in the industry. There is no knowledge or report contrary to that belief in any relevant literature. In view of that, in productions and applications, for axle-type workpieces that are immersed and quenched in a vertical state, the as-quenched hardness is usually checked only at specified spots, and the uniformity of the as-quenched hardness of the entire workpiece is seldom checked in the axial direction. However, in actual detection the as-quenched hardness in the axial direction is not uniform on axle-type workpieces obtained by cooling with the existing quenching method; the hardness values at specified local spots can't truly reflect the quenching cooling effect of the entire workpiece. After such workpieces with non-uniform as-quenched hardness are put into use, some problems may occur, such as compromised mechanical properties and shortened service life, etc., and accidents may even occur in the service life of the parts.

Presently, to ensure that the workpieces meet the specified quenching quality, some measures can be taken to improve the cooling uniformity and as-quenched hardness of the workpieces, such as stirring. In general, the uniformity of as-quenched hardness of a workpiece can be improved by improving the uniformity of cooling of the workpiece. However, due to the difference in shape complexity between workpieces and hardenability between materials, uniform cooling does not ensure uniform as-quenched hardness. It is believed that the uniformity of temperature of the quenching oil can be improved if the quenching oil is stirred well, and thus the uniformity of cooling and uniformity of as-quenched hardness of the workpiece can be improved. Moreover, stirring can strengthen the heat exchange between the workpiece and the quenching oil and thereby improve the as-quenched hardness of the workpiece. However, it is impossible to obtain the same cooling effect for different workpieces quenched in the same furnace or different parts of the same workpiece in quenching oil at a uniform temperature, due to the characteristics of medium stirring and complexity of stirring problems. In addition, a uniform quenching oil temperature doesn't mean uniform as-quenched hardness of the workpiece, due to the influences of workpiece shape and position. Consequently, even workpieces quenched in the same furnace often have the problem that some of the workpieces have quenching deformation or unacceptable hardness.

CONTENTS OF THE INVENTION

In a first aspect, the present invention provides an oil-immersion quenching cooling precursor that is separated into a plurality of sections to expel gas bubbles, to improve the as-quenched hardness and uniformity of hardness of an axle-type workpiece. The workpiece is an axle-type workpiece or workpiece that has section(s) in an axle form; the oil-immersion quenching cooling precursor is an axle-type workpiece or workpiece that has section(s) in an axle form on which several separation rings are arranged in the axial direction to separate the workpiece into a plurality of sections in the axial direction before oil-immersion quenching cooling, and the workpiece is separated into a plurality of sections to expel gas bubbles.

The separation rings are distributed on the surface of the workpiece in the axial direction.

The separation rings are machined integrally with the axle-type workpiece.

At least one separation ring is arranged on the workpiece.

The longitudinal cross-section of the separation ring can be a rectangular shape, sloped shape, stepped shape, triangular shape, or other irregular shape.

The top of the separation ring can be a flat top, domed top or spire top.

The length (L) of a part of the separation ring that is coupled with the outer surface of the workpiece in the axial direction of the workpiece (i.e., base thickness) is 1-20 mm.

The length (h) of an outer edge of the separation ring in relation to the outer surface of the workpiece in the radial direction of the workpiece (i.e., height) is 1-10 mm.

The spacing (b) between adjacent separation rings is 10 mm-200 mm.

The spacing between the separation rings may be even or uneven.

In a second aspect, the present invention provides an oil-immersion quenching cooling method for a workpiece, comprising: heating up the oil-immersion quenching cooling precursor described above and immersing the oil-immersion quenching cooling precursor into oil to accomplish quenching cooling.

In a third aspect, the present invention provides a workpiece processing method, comprising the oil-immersion quenching cooling method described above and a procedure of removing the separation rings to obtain a workpiece with required dimensions after quenching cooling.

The separation rings are removed by cutting, and the cut parts are cooled.

The workpiece processing method further comprises a tempering procedure of the workpiece, after which the procedure of removing the separation rings is executed.

In a fourth aspect, the present invention provides a workpiece obtained with the processing method described above, wherein, the workpiece is an axle-type workpiece or workpiece that has section(s) in an axle form.

Compared with the prior art, the present invention attains the following beneficial effects:

1. Improving inherent quality of the workpiece: utilizing the oil-immersion quenching cooling precursor provided in the present invention in the quenching process can effectively improve as-quenched hardness and uniformity of as-quenched hardness of a workpiece (especially an axle-type workpiece), reduce quenching deformation of the workpiece, and improve fatigue life of the workpiece.

2. Saving alloy element resources: since utilizing the oil-immersion quenching cooling precursor provided in the present invention can improve as-quenched hardness of a workpiece, steel with lower hardenability can be used instead of steel with higher hardenability for some types of workpieces, and therefore alloy element resources are saved.

3. Reducing production cost: for some type of workpieces, when the oil-immersion quenching cooling precursor provided in the present invention is used as a transitional workpiece in the quenching cooling process, ordinary quenching oil can be used in the quenching process to obtain the same quenching cooling effect that can be obtained with fast quenching oil.

4. Improving production efficiency: the oil-immersion quenching cooling precursor and oil-immersion quenching cooling method provided in the present invention can greatly shorten the quenching cooling time of a workpiece, and that effect is even more obvious when the oil-immersion quenching cooling precursor and oil-immersion quenching cooling method provided in the present invention are used for large-size axle-type workpieces.

5. The oil-immersion quenching cooling precursor provided in the present invention has advantages including: simple principle, excellent and steady effect, and extremely high uniformity, etc. Therefore, if the oil-immersion quenching cooling precursor and oil-immersion quenching cooling method provided in the present invention is used in combination with the existing process and method, i.e., separation rings are worked out at appropriate parts of a workpiece before quench heating, it is possible to greatly reduce or even eliminate defective products in the quenching process.

DETAILED DESCRIPTION OF THE EMBODIMENTS

Figure 1:
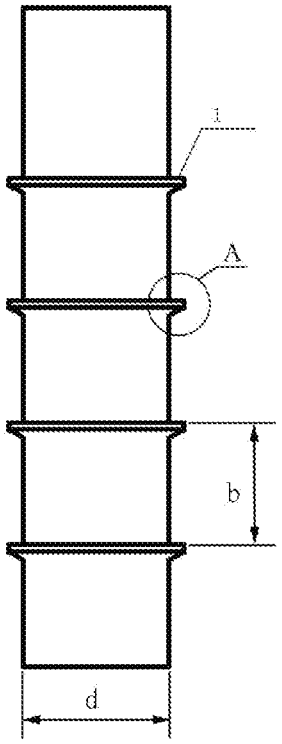
FIG. 1 is a schematic structural diagram of the oil-immersion quenching cooling precursor according to the present invention.

In recent years, the inventor of the present invention has studied liquid-immersion quenching cooling processes of a variety of test samples through extensive tests, and has found that the parts of the same workpiece that have the same effective thickness usually can't obtain the same quenching cooling effect in the quenching cooling process. For example, though the upper part and lower part of an axle-type workpiece have the same effective thickness, their cooling effects are quite different from each other. Up to now, there is no such report in relevant literatures or the industry. Moreover, except for the inventor of the present invention, no one has reported that the gas in a vapor film on the surface of a workpiece can flow and the vapor film can release gas bubbles in a liquid-immersion quenching process. Furthermore, no one has reported that the gas flow in the vapor film and the released gas bubbles have influence on the cooling rate and cooling uniformity of the workpiece.

Over a decade, the inventor has carried out extensive video recording and observation on the quenching cooling process of samples in oil and water and has conducted analytical study on numerous observed phenomena. It was found that the gas in the vapor film can flow and the flow pattern has influence on the cooling rate and cooling uniformity of the workpiece. In addition, it was found that there is no definite one-to-one correspondence relationship between the transition from vapor film cooling mode to boiling cooling mode on the surface of a workpiece and the surface temperature of the workpiece. Rather, there is a special law. The inventor has concluded from the research findings that two new factors have influence on the cooling rate and cooling uniformity of a workpiece in the quenching process: first, the gas flow pattern in the vapor film, and second, the sequence of transition from vapor film cooling mode to boiling cooling mode. These new factors revealed a theory on why an axle-type workpiece quenched in a vertical state can't obtain high and uniform quenching cooling hardness. In addition, utilizing the new theory, the invention has put forward a quenching cooling method in the present invention to solve such problems.

The inventor has further found that the gas in the vapor film on the surface of a workpiece can flow in the liquid-immersion quenching process and the hot gas will be released in a form of gas bubbles from the top of the vapor film. Based on this the inventor has drawn the conclusion that the gas flow in the vapor film has influence on the cooling rate and cooling uniformity of the workpiece. In addition, in the quenching cooling process, the transition from vapor film cooling mode to boiling cooling mode is realized by occurrence of a hyper-spreading spot and demarcation line borrowing long before the thickness of the vapor film reaches zero. Finally, by summarizing the newly discovered phenomena and research findings, the inventor has concluded two new factors that have influence on the cooling rate and cooling uniformity of a workpiece in the liquid-immersion quenching process: one factor is the gas flow in the vapor film on the surface of the workpiece; the other factor is the sequence of transition from vapor film cooling mode to nucleate boiling (hereafter simply referred to as boiling) mode.

In the first factor, the inventor has found that the gas flow pattern in the vapor film is as follows: the gas in the vapor film is evaporated from the liquid surface at the outer side of the vapor film. In the gas in the vapor film, the gas in the inner layer closest to the outer surface of the workpiece has the highest temperature, while the gas in the outer layer closest to the liquid surface has the lowest temperature. Namely, the gas temperature distribution in the vapor film is very uneven. For axle-type workpieces, in the vapor film along the vertical surface, the temperature of the gas in the outer layer close to the liquid surface in the vapor film is essentially the same, regardless of the vertical position (usually, the temperature of the gas in the outer layer is slightly higher than the boiling temperature of the cooling medium). Since there is a high temperature difference between the gas in the inner layer and the gas in the outer layer, the gas in the vapor film will flow.

Figure 3:
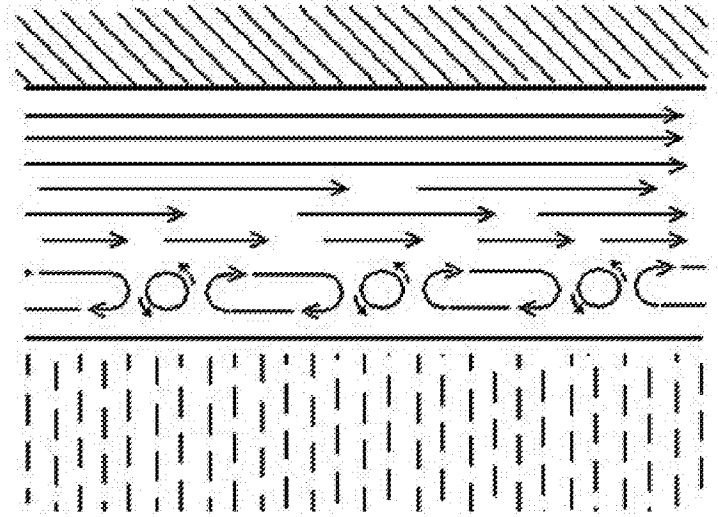
FIG. 3 is a schematic diagram of gas flow in a vapor film along the vertical surface of a workpiece without separation rings.

Possible gas flow patterns include laminar flow and circulative convection flow. FIG. 3 is a schematic diagram of a typical gas flow pattern in a vapor film along the vertical surface of a workpiece; the flowing gas in the vapor film can be divided by the flow pattern into a laminar flow layer closest to the high-temperature workpiece, a circulative convection flow layer closest to the liquid surface, and an intermediate portion between the two layers.

Wherein, the gas in the inner layer flows upward and becomes the laminar flow layer that flows upward vertically along the surface of the workpiece. The gas transferred upward in the laminar flow layer is always the part of gas that has the highest temperature in the gas at the same elevation. The gas transferred in the laminar flow layer is released in a form of gas bubbles into the quenching liquid from the top of the vapor film above the workpiece. The gas evaporated from the liquid surface below the workpiece is released from the vapor film above the top of the workpiece continuously. In the upward flowing process, since the laminar flow layer is the closest to the surface of the high-temperature workpiece and is further heated by the high-temperature surface, the temperature of the gas in the laminar flow layer is increased continuously, and causes decreased heat dissipation rate at the surface above the workpiece. In other words, the cooling effect above the workpiece is weakened. Such an action may be regarded as a heating action of the gas in the laminar flow layer to the workpiece surface above the gas. Consequently, in the outer surface of the workpiece that has the same effective thickness, the surface of the upper part is cooled more slowly than the surface of the lower part; moreover, the longer the axle-type workpiece is, the longer the path along which the laminar flow layer is heated is, and the higher the difference between the cooling rate of the upper part of the workpiece and that of the lower part of the workpiece is. For any axle-type workpiece (or any workpiece that has section(s) in an axle form, i.e., sections in an axle form on workpieces in other shapes), such a problem inevitably exists when the axle-type workpiece is quenched in a vertical state.

The circulative convection mentioned here only happens in the gas within a range from the intermediate portion in the vapor film to the liquid surface, as shown in FIG. 3. The gas in the outermost layer has a tendency of flowing downward, because the gas in the outermost layer contacts with the liquid phase outside of the vapor film and has the lowest temperature since the temperature of the liquid phase can't exceed the boiling point of the medium, the gas in the outermost layer is further cooled by the liquid surface, and the liquid evaporation process is an endothermic process. In contrast, the gas close to the intermediate portion at the other side in the vapor film has a tendency of flowing upward, because it is closer to the workpiece surface and its temperature will be further increased under the stronger heating effect from the workpiece. Under the effects of the two tendencies, a circulative convection flow pattern in sections as shown in FIG. 3 is formed. The circulative convection happens only within the respective sections. The circulative convection has two major effects on the quenching cooling process of the workpiece. One effect is to convey the gas of the medium evaporated from the liquid surface to the intermediate layer and finally convey it to the laminar flow layer. The other effect is to transfer a part of heat dissipated from the workpiece to the liquid surface by heat convection. Part of the heat is consumed in the evaporation of the medium at the liquid surface or transferred to the medium outside of the liquid surface.

In the second factor, the inventor has found that the law of sequence that has influence on the transition of the vapor film is: on the surface of the same workpiece having the same effective thickness, such a transition can happen starting from a vapor film area that is so small that it can be referred to as a "spot", by dint of thickness fluctuation of the vapor film, only after the surface temperature is decreased to be lower than a characteristic temperature value ($T^0$—minimum surface temperature of the workpiece, at which the transition from vapor film cooling mode to boiling cooling mode absolutely can't happen); the small vapor film area where the transition starts is referred to as a hyper-spreading spot (the term "hyper" is used here because the thickness of the vapor film at that spot is still quite large and not reduced to zero yet when the transition happens). The boundary between the boiling cooling area and the vapor film area after the transition happens on the surface of the workpiece is referred to as a demarcation line. Then, as the demarcation line spreads towards the vapor film area, the vapor film portion where the demarcation line has spread over transitions gradually. Due to the transition pattern on the surface of a workpiece having the same effective thickness is sequential. Such a transition of the vapor film on the surface by dint of the arrival of the demarcation line is referred to as demarcation line borrowing.

Through research, the inventor has found that $T^0$ is higher than the boiling temperature of the cooling medium by about 100° C. at the most (although sometimes actually higher by about 20° C.), instead of higher than the boiling temperature of the cooling medium by hundreds of degrees Celsius as widely believed in the industry. In fact, the temperature at which the transition happens on the surface is much lower than $T^0$. That is to say, in the quenching cooling process, the temperature range of the surface that can be covered by the vapor film at any part of the workpiece starts from a temperature near the quenching heating temperature of the workpiece (e.g., about 850° C.) and extends as far as to a temperature higher than the boiling point of the quenching liquid by several dozens of degrees Celsius. The findings indicate that: if different cooling patterns are sorted by their contribution to the workpiece quenching cooling effect, the cooling pattern that makes the greatest contribution is the cooling pattern before the transition, i.e., the cooling pattern exists when the surface of the workpiece is covered by the vapor film. For that reason, in practical applications, the cooling rates at different parts of the surface of a workpiece can be determined roughly according to the arrival time of the demarcation line: a part where the demarcation line arrives earlier is cooled faster, while a part where the demarcation line arrives later is cooled more slowly.

Figure 9:
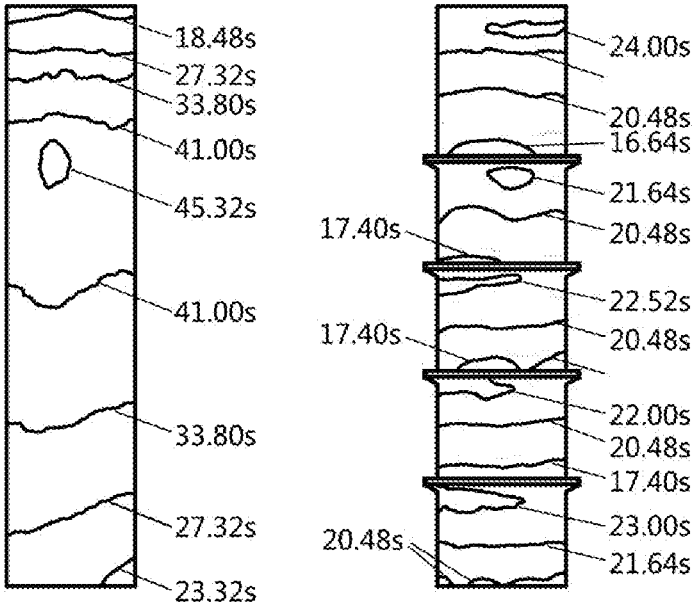
FIG. 9 is a diagram of the spreading of demarcation lines of a sample of an axle-type workpiece and a sample of the oil-immersion quenching cooling precursor according to the present invention in the quenching cooling process in experimental example 1.

As shown in FIG. 9, in the quenching cooling process, on an oil-immersion quenching cooling precursor (hereafter simply referred to as "precursor") with separation rings, the demarcation line appears at the footing of a separation ring (the part where the separation ring contacts the workpiece substrate) first, and spreads extensively towards the substrate surface only when the temperature of the substrate surface in the vicinity drops to lower than $T^0$. That is to say, the part where a separation ring exists is always the part that is cooled the fastest on the workpiece substrate. Therefore, it is unnecessary to worry that the part can't be quenched because of the separation ring.

The results of tests and observations also demonstrate that the cooling time in the boiling cooling mode on the surface of a sample is usually very short, while the cooling time in the vapor film cooling mode is much longer relatively in the quenching cooling process.

Figure 4:
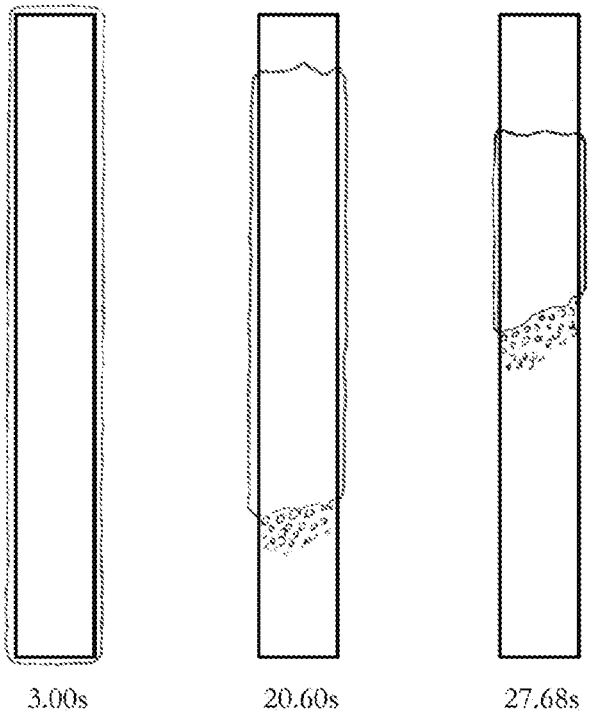
FIG. 4 is a diagram of states of an axle-type workpiece without separation rings at different moments in the quenching cooling process.
Figure 5:
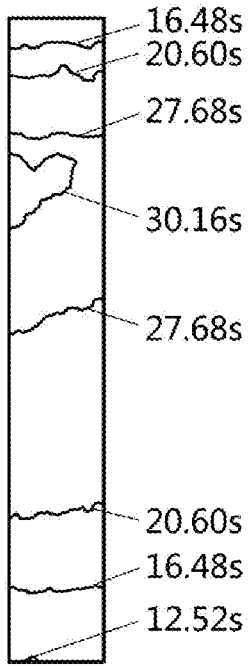
FIG. 5 is a diagram of spreading of demarcation line of the axle-type workpiece without separation rings in FIG. 4 in the quenching cooling process.

The degree of cooling non-uniformity in the quenching cooling process of an axle-type workpiece in vertical state can be demonstrated in a simple test. A Φ20×135 mm cylindrical sample is heated to 850° C. and then quenched in base oil in a vertical state. FIG. 4 is a diagram of the states of the sample at three different moments in the cooling process. FIG. 5 is a diagram of demarcation line spreading. The numbers labeled in the figures are the cooling times of the sample starting from the moment when the sample is immersed into the oil.

Hereunder an analysis is made with reference to FIGS. 4 and 5. In the left diagram in FIG. 4: the vapor film at the top of the sample is releasing gas bubbles; in FIG. 5, when the sample is cooled to 12.52 s, a hyper-spreading spot occurs at the bottom edge of the sample. This indicates that the entire sample is covered by the vapor film integrally within 12.52 s after the sample is immersed into the oil. Then, the demarcation line spreads upward from the bottom part of the sample; after about 4 s (at 16.48 s), a hyper-spreading spot occurs at the top edge of the sample. As shown in the right diagram in FIG. 4, the demarcation line at the bottom part spreads upward faster, while the demarcation line at the top part spreads downward more slowly. At that point, as shown in the middle and right state diagrams in FIG. 4, released gas bubbles can be seen at the top edge of the vapor film area. When the sample is cooled to 30.16 s, a small piece of vapor film still exists at the upper part of the sample. On a sample having the same effective thickness (in 20 mm diameter only), the time difference between the moment when the first piece of vapor film transits and the moment when the last piece of vapor film disappears is as high as 17.8 s. Undoubtedly, such a high time difference will cause a severe structural transformation difference on the sample. If the sample is longer and/or the diameter is greater, the time difference surely will be greater and cause more severe cooling non-uniformity. This is the cause for the quenching cooling problem that exists in almost all axle-type workpieces treated by oil-immersion quenching cooling in a vertical state.

Figure 6:
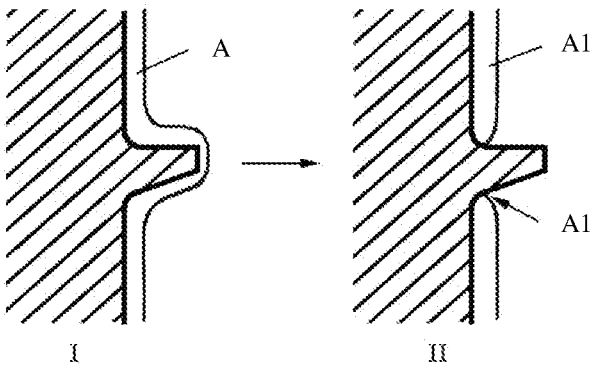
FIG. 6 is a schematic diagram of the action principle of separation rings in the method according to the present invention.

Based on the above finding, the inventor puts forward a solution to the problem: separating the laminar flow layer of the vapor film that should extend continuously from the bottom end of an axle-type workpiece to the top end into a plurality of sections, and enabling each of the sections to release gas bubbles from the top. In addition, the separation rings configured to separate the laminar flow layer can transition soon after the workpiece is immersed into the liquid, so that demarcation lines required for transition can be provided to the vapor film in the sections near the separation rings, as shown in FIG. 6. By decreasing the elevation difference of each section and shortening the demarcation line spreading path, the temperature difference between the top end and the bottom end of each section incurred by the laminar flow layer can be decreased, and the time required for demarcation line spreading can be shortened, and the entire axle-type workpiece can obtain a faster and more uniform quenching cooling effect.

The present invention will be further detailed in embodiments, but those embodiments should not be understood as constituting any limitation to the present invention.

Figure 2:
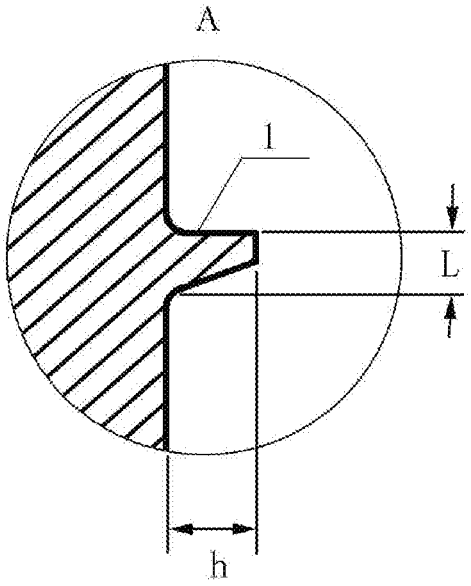
FIG. 2 is a partially enlarged view of a separation ring in FIG. 1.

The oil-immersion quenching cooling precursor that is separated into a plurality of sections to expel gas bubbles in the present invention will be detailed in examples of axle-type workpieces. In the machining work before quenching, several separation rings 1 are worked out on the surface of an axle-type workpiece, as shown in FIG. 1. The workpiece may also be referred to as a "substrate", the separation rings are distributed parallel to each other in the axial direction of the workpiece. To work out horizontal rings distributed in planes perpendicular to the axial direction of the workpiece, the workpiece is separated into a plurality of sections in the axial direction, as shown in FIG. 2. The longitudinal cross section of the separation ring may be in a rectangular shape, sloped shape, stepped shape, or triangular shape. The top may be a flat top, domed top, or spike top. The base thickness L of the separation ring (the base thickness refers to the length of the part of the separation ring that contacts with the outer surface of the workpiece substrate in the axial direction) is selected within a range of 1-20 mm. The height h of the separation ring (the height refers to the length of an outer edge of the separation ring along the outer surface of the workpiece substrate in the radial direction) is selected within a range of 1-10 mm. Both the base thickness and the height depend on the diameter d of the workpiece. Usually, the greater the diameter of the workpiece is, the greater the base thickness is, and the greater the height is. The spacing b between adjacent separation rings may be selected within a range of 10 mm-200 mm. The spacing between the separation rings may be even or uneven. In the machining process, there is no particular requirement for the quality of the steel material of the separation ring parts and the machining accuracy. Separation rings can be worked out on most workpieces within the allowance reserved for machining before quenching. Therefore, the separation rings may be deemed as "reserved" rather than "worked out". Usually the separation rings are removed by cutting or grinding after the quenching cooling procedure and tempering procedure, etc. are finished; alternatively, the separation rings may be removed after the quenching cooling procedure and the tempering procedure are finished. In the machining for removing the separation rings, the cooling at the cut parts must be strengthened to prevent overheating of the parts on the workpiece surface.

In the oil-immersion quenching cooling precursor and the oil-immersion quenching cooling method provided in the present invention, the action principle of the separation rings is as follows: the base thickness of the separation ring is much smaller than the diameter of the workpiece substrate; therefore, within a very short time early in the liquid-immersion quenching, the majority of surfaces of the separation rings can be cooled to lower than the boiling temperature of the cooling medium, as shown in FIG. 6, wherein, the symbol I represents the vapor film at the beginning of the oil-immersion quenching, and the symbol II represents the vapor film separated by the separation rings. Since the vapor film no longer exists on the surfaces of the separation ring, the vapor film "A" that was integral in the vertical direction is separated into a plurality of sections; the symbol "A1" represents the vapor film within a section. At the same time, a loop of demarcation line is formed at the upper footing and lower footing of each separation ring respectively, as shown by the symbol "II" in FIG. 6. Since the elevation difference between the top end and the bottom end of each vapor film section is greatly shortened, the temperature difference on the workpiece of the substrate surface in the same section will be decreased accordingly. Since the upper part is cooled more slowly than the lower part in each section of vapor film area, a hyper-spreading spot always appears at the bottom end of a section first. In the follow-up cooling process, when the surface temperature of the workpiece substrate adjacent to the demarcation line drops to be lower than $T^0$, the demarcation line will spread towards the substrate surface. Since all the sections separated by the separation rings are very short, the time required for accomplishing demarcation line spreading is very short. Thus, the cooling rates of the workpiece in the sections are greatly increased. If the spacing between the separation rings is even, in the sections separated by the separation rings, the spreading of the demarcation lines at the corresponding part can happen almost synchronously. This is why almost the same quenching cooling effect can be obtained on the entire axle-type workpiece in the present invention.

To prove the effect of the oil-immersion quenching cooling method provided in the present invention and verify the difference between the method provided in the present invention and the existing method in terms of cooling effect, the following experimental examples are used.

Experiment Example 1

Comparison of Cooling Time

Figure 7:
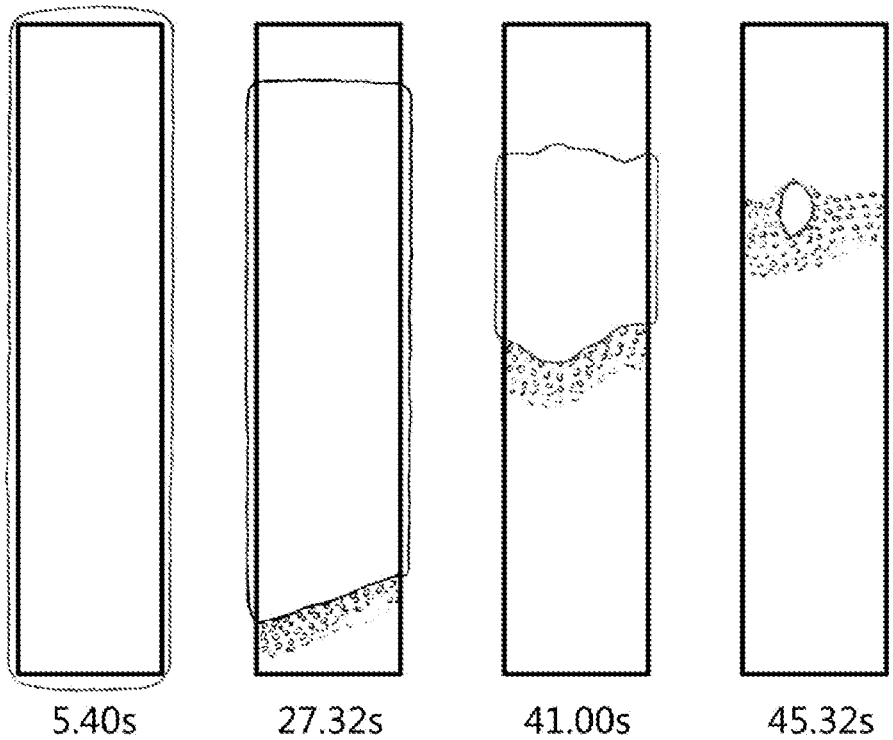
FIG. 7 is a diagram of states of a sample of an axle-type workpiece without separation rings at different moments in the quenching cooling process in experimental example 1.
Figure 8:
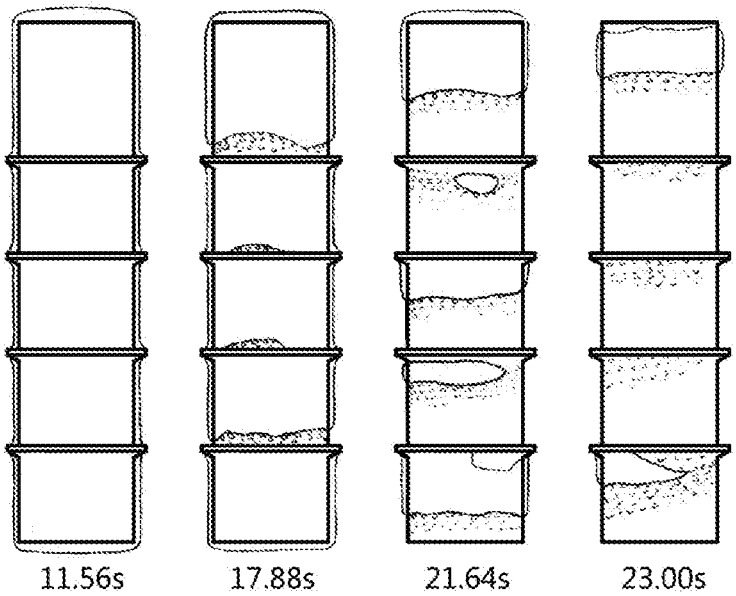
FIG. 8 is a diagram of states of a sample of the oil-immersion quenching cooling precursor according to the present invention in the quenching cooling process in experimental example 1.

Two samples are taken, wherein, one sample is a sample 1a without separation ring, the other sample is a sample 1b with separation rings, both of the two samples have dimensions of Φ30 cm×135 cm, the axial cross section of each separation ring is in a trapezoid shape, the top part is a horizontal surface, the bottom part is a beveled surface, the base thickness is 2 mm, the top thickness is 1 mm (the top thickness refers to the length of the separation ring calculated from the farthest point from the workpiece substrate in the axial direction), the height is 3 mm, the spacing between the separation rings is 25 mm, both the sample with separation rings and the sample without separation rings are heated up to 850° C. under the same conditions, and then are quenched in the same oil in a vertical state. FIGS. 7-9 show the state change of the two samples 1a and 1b in the quenching cooling process. FIG. 7 and FIG. 8 show four diagrams of states of the sample 1a without separation rings and sample 1b with separation rings at different moments in the cooling process respectively. FIG. 9 shows the demarcation line spreading of the two samples, wherein, the label numbers are the cooling times of the samples in the oil. In FIG. 8: in the sample 1b with separation rings, gas bubbles are released above the vapor film in each section. In contrast, in FIG. 7, in the sample 1a without separation rings, only one integral vapor film area exists, and the gas bubbles have to be released from the top of the vapor film; the cooling time required for accomplishing demarcation line spreading on the sample is 45.40 s; the cooling time required for accomplishing demarcation line spreading on the sample 1b with separation rings is 24.04 s, shorter than the cooling time of the sample 1a without separation rings by 21 s. In FIG. 9: in the three middle sections separated by four separation rings, the demarcation lines start to spread at 17.40 s, and the time when the demarcation line spreading is accomplished is at about 22 s; the cooling time of demarcation line spreading in each section is as short as about 4.6 s. On the sample 1a without separation rings, the demarcation lines start to spread at 17.80 s and the spreading is accomplished at 45.40 s, the cooling time difference between the two moments is 27.6 s. With the separation rings, the sample obtains a faster and more uniform cooling effect. The cooling effect of the axle-type workpiece quenched with the method provided in the present invention is very steady and quite uniform.

Experimental Example 2

Comparison of As-Quenched Hardness

Figure 10:
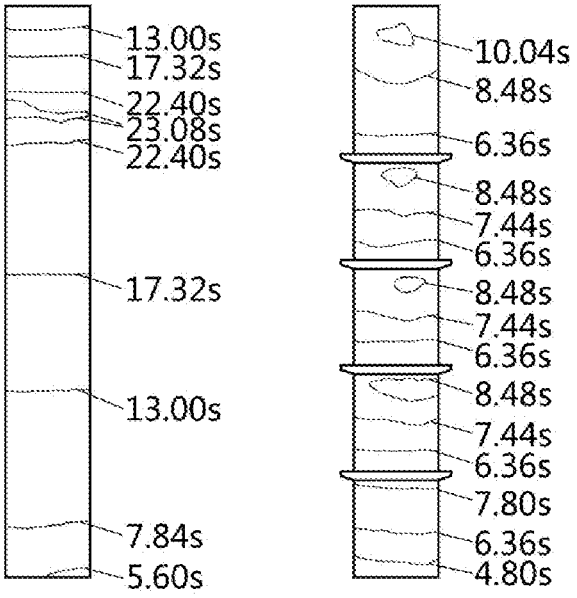
FIG. 10 is a diagram of the spreading of demarcation lines of a sample of an axle-type workpiece and a sample of the oil-immersion quenching cooling precursor according to the present invention in the quenching cooling process in experimental example 2.

A sample 2b with separation rings and a sample 2a without separation rings are worked out from the same 45 lb steel bar. Both test substrates have dimensions of Φ20×135 cm, except that the sample 2b with separation rings has four separation rings. The shapes, dimensions, and spacing of the separation rings are the same as those in the experimental example 1. Both samples are heated up to 850° C. under the same conditions, and then are cooled in the same fast quenching oil in a vertical state. The diagram on the left in FIG. 10 shows the demarcation line spreading on the samples 2a without separation rings, and the diagram on the right shows the demarcation line spreading on the sample 2b with separation rings.

From the diagrams: the bottom end of the sample 2a without separation rings is cooled faster, and a hyper-spreading spot occurs there at 5.5 s; the top end is cooled more slowly, and a hyper-spreading spot occurs there later; furthermore, the demarcation line at the bottom end spreads upward more quickly, and the demarcation line at the top end and the demarcation line at the bottom end meet each other at 40 mm from the top at about 23.1 s. The demarcation line spreading takes 17.6 s, from 5.5 s to 23.1 s.

From the diagram of demarcation line spreading on the sample 2b with separation rings: the demarcation lines in the three middle sections separated by the separation rings start to spread at 6.2 s, and the moment when the last piece of vapor film disappears is at 8.5 s; the demarcation line spreading takes 2.3 s only. The sample with separation rings is cooled faster. Since the cooling processes of the three sections are the same, it indicates that the cooling effect is uniform and steady.

Figure 11:
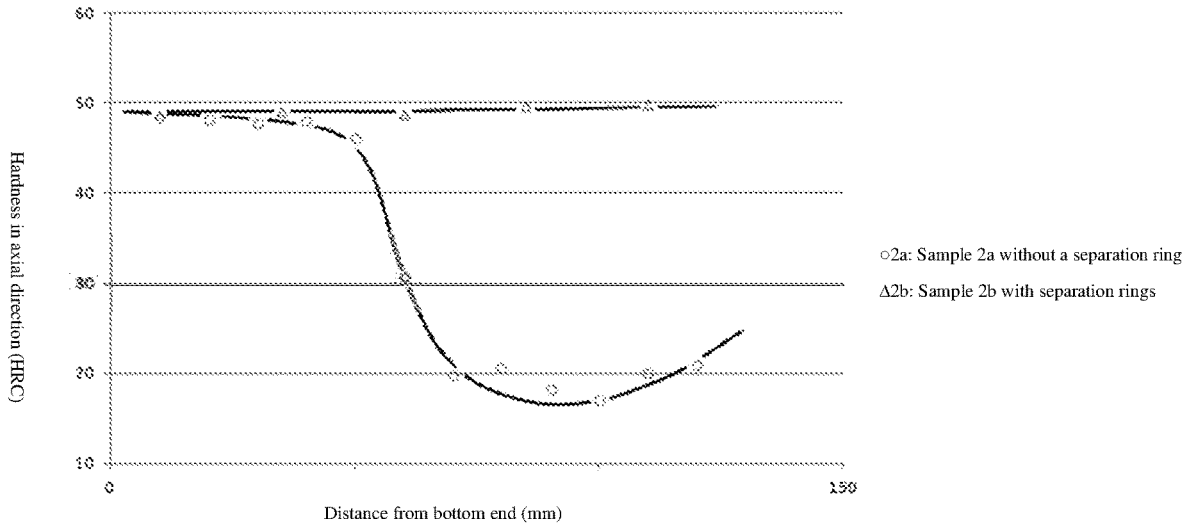
FIG. 11 shows the comparison between the curve of surface hardness distribution of a sample of an axle-type workpiece without separation rings and that of a sample of the oil-immersion quenching cooling precursor according to the present invention in a quenched state in experimental example 2.

After the quenching cooling, the separation rings on the sample 2b are ground off. Then, at the middle parts of the sections separated by the separation rings, the surface hardness is measured in the axial direction respectively. On the sample 2a without separation rings, the surface hardness distribution in the axial direction is measured directly. Next, the surface hardness distribution curves of the two samples in quenched state are plotted, as shown in FIG. 11.

The comparison between the two curves shows: From bottom to top, the sample 2a without separation rings obtains 50 HRc hardness only within a range smaller than 30 mm from the bottom end, and then the hardness begins to decrease; the hardness drops to be lower than 20 HRc rapidly within the range of 50 mm to 80 mm from the bottom end, and drops to a minimum value of about 18 HRc at about 90 mm from the top end; then, the hardness gradually returns to 25 HRc at the top end; the maximum hardness and minimum hardness on the surface are 50 HRc and 18 HRc respectively, with 32 HRc difference between them. This result matches the part where the demarcation line spreading is accomplished. In contrast, the surface hardness curve of the sample 2b with separation rings in the axial direction is very steady, and is always at about 50 HRc.

In this experiment example, three conclusions can be drawn: 1. The sample with separation rings obtains higher and more uniform as-quenched hardness. 2. If no separation ring is arranged on the sample, a steel material that has better hardenability has to be used (e.g., 42CrMo) for the sample to obtain as-quenched surface hardness not lower than 50 HRC along the full length of the sample. Thus alloy element resources can be saved by applying the method provided in the present invention. 3. After separation rings are applied, the surface hardness distribution curve is independent of the sample length. That is to say, no matter how the sample length is increased, the same as-quenched hardness value can be obtained along the full length.

Experimental Example 3

Comparison of Quenching Oil

The two samples used in this experiment are taken from the same 42CrMo bar, have dimensions of Φ20×135 mm, wherein, one sample is a sample 3a without separation rings, the other sample is a sample 3b with separation rings, and the shapes, dimensions, and spacing of the separation rings are the same as those in the experimental example 1. The two samples are heated up to 850° C. under the same conditions; then the sample 3b with separation rings is cooled in 60 SN base oil in a vertical state, while the sample 3a without separation rings is cooled in fast quenching oil in a vertical state. In this experimental example, 60 SN base oil replaces the original fast quenching oil to quench the sample 3b with separation rings, and the result is compared with the result of the sample 3a without separation rings quenched in fast quenching oil. Table 1 shows the comparison of cooling characteristics between the 60 SN base oil and the fast quenching oil (at 50° C. oil temperature, without stirring).

TABLE 1

Comparison between Cooling Characteristics of 60SN Base Oil and Fast Quenching Oil

| Performance | 60SN base oil (used for sample 3b with separation rings) | Fast quenching oil (used for sample 3a without separation rings) |
|---|---|---|
| Maximum cooling rate, ° C./s | 75 | 102 |
| Temperature at maximum cooling rate, ° C. | 521 | 621 |
| Characteristic temperature, ° C. | 625 | 742 |
| Time to 600° C., s | 11.47 | 6.39 |
| Time to 400° C., s | 14.85 | 9.83 |
| Time to 200° C., s | 43.16 | 44.03 |

The Table 1 indicates that there is a great difference in cooling performance between the fast quenching oil and the base oil, and the cooling rate attained with the fast quenching oil is much higher than that attained with the base oil.

After the quenching is finished, the as-quenched surface hardness is measured in the axial direction on the two samples. Table 2 shows the comparison of surface hardness between the two samples.

TABLE 2

Comparison of As-Quenched Surface Hardness between the Sample with Separation Rings and the Sample without Separation Ring

| | Surface hardness in axial direction, HRc | |
|---|---|---|
| Distance from bottom surface, mm | Sample 3b with separation rings (60SN base oil) | Sample 3a without separation ring (fast quenching oil) |
| 12 | 53.3 | 54.5 |
| 32 | 53.6 | 54.6 |
| 52 | 51.2 | 53.8 |
| 72 | 51.6 | 53.9 |
| 92 | 52.8 | 53.9 |
| 102 | 53.8 | 53.3 |

It is seen from the test results in Table 2: when the sample with separation rings is quenched in 60 SN base oil, it obtains as-quenched hardness almost equivalent to that obtained by the sample without separation ring quenched in fast quenching oil. This indicates that the base oil can replace the fast quenching oil to reduce cooling medium cost. The reason why the surface hardness of the workpiece without separation ring is uniform as indicated in the Table 2 is as follows: because a 42CrMo bar is used for the samples in this experimental example, it is difficult to meet the requirement for as-quenched hardness if 60 SN base oil is directly used for the quenching; the requirement for as-quenched hardness can only be met if the fast quenching oil is used. However, fast quenching oil is not only expensive and increases application cost, but also involves higher carried quantity. It is a challenge to add a quenching tank to receive the fast quenching oil on a production site that is already crowded. The method provided in the present invention can meet the requirement for as-quenched hardness with just 60 SN base oil.

INDUSTRIAL APPLICABILITY

The oil-immersion quenching cooling precursor that is separated into a plurality of sections to expel gas bubbles and the oil-immersion quenching cooling method provided in the present invention are capable of improving the inherent quality of a workpiece, saving alloy element resources, improving production efficiency and reducing production cost, and are suitable for industrial application.

What is claimed is:

1. An oil-immersion quenching cooling precursor of a workpiece that is of an axle type or has sections in an axle form, comprising:

a plurality of separation rings on the axle-type workpiece or workpiece that has sections in an axle formed in an axial direction of the workpiece, the plurality of separation rings separating the workpiece into a plurality of sections, each of the plurality of sections having a same constant diameter between a pair of the separation rings, and each of the plurality of separation rings having same dimensions; wherein a length (L) or base thickness of a part of a separation ring that is coupled with an outer surface of the workpiece in the axial direction of the workpiece is 1-20 mm, a height (h) of an outer edge of a separation ring of the plurality of separation rings in relation to the outer surface of the workpiece in a radial direction of the workpiece is 1-10 mm, a spacing (b) between adjacent separation rings is 10 mm-200 mm, and at least one separation ring of the plurality of separation rings has an upper surface that is perpendicular to an axis of the workpiece and a lower surface opposite the upper surface, the lower surface being sloped relative to the axis.

2. The oil-immersion quenching cooling precursor according to claim 1, wherein the plurality of separation rings are distributed a same spacing apart in the axial direction along an outer surface of the workpiece.

3. The oil-immersion quenching cooling precursor according to claim 1, wherein the separation rings are integrated with the axle-type workpiece.

4. The oil-immersion quenching cooling precursor according to claim 1, wherein a longitudinal cross section of a separation ring of the plurality of separation rings is in a rectangular shape, sloped shape, stepped shape or triangular shape.

5. The oil-immersion quenching cooling precursor according to claim 1 wherein a top of a separation ring of the plurality of separation rings is a flat top, domed top, or spire top.

6. The oil-immersion quenching cooling precursor according to claim 1, wherein, a spacing between the separation rings is even.

7. The oil-immersion quenching cooling precursor according to claim 1, wherein spacing between the separation rings is uneven.

* * * * *